US005431528A

United States Patent [19]

Jenkins et al.

[11] Patent Number: 5,431,528

[45] Date of Patent: Jul. 11, 1995

[54] QUICK COUPLING ARRANGEMENT FOR EXCAVATOR BUCKETS AND THE LIKE

[76] Inventors: Robert D. Jenkins, 29 Shaw Lane; Murray S. McKnight, Lincoln Park, both of Fredericton, New Brunswick, Canada

[21] Appl. No.: 81,669

[22] Filed: Jun. 23, 1993

[30] Foreign Application Priority Data

Jun. 26, 1992 [CA] Canada ..... 2072342

[51] Int. Cl.[6] ..... E02F 3/36

[52] U.S. Cl. ..... 414/723; 37/468; 172/275; 403/324

[58] Field of Search ..... 414/723, 686; 403/116, 403/158, 161, 321, 324; 172/272-275; 37/468

[56] References Cited

U.S. PATENT DOCUMENTS

| | | | |
|---|---|---|---|
| 3,556,323 | 1/1971 | Heimmermann | 414/723 |
| 3,760,883 | 9/1973 | Birk | 172/273 |
| 4,013,182 | 3/1977 | Pratt et al. | 414/723 |
| 4,116,347 | 9/1978 | Uchida | 414/723 |
| 4,204,794 | 5/1980 | Aoshiba | 414/723 |
| 4,214,840 | 7/1980 | Beales | 403/31 |
| 4,243,356 | 1/1981 | Takojima | 414/723 |
| 4,452,560 | 6/1984 | Coyle et al. | 414/723 |
| 4,787,811 | 11/1988 | Langenfeld | 414/723 |
| 4,854,813 | 8/1989 | Degeeter | 414/723 |
| 4,986,722 | 1/1991 | Kaczarczyk et al. | 414/723 |

FOREIGN PATENT DOCUMENTS

| | | |
|---|---|---|
| 1081171 | 7/1980 | Canada . |
| 1109427 | 9/1981 | Canada . |
| 1198091 | 12/1985 | Canada . |
| 1248498 | 1/1989 | Canada . |
| 1259958 | 9/1989 | Canada . |

OTHER PUBLICATIONS

"Excavator Quick Coupler", Weldco-Beales Nov. 1986 2 pages.

"Cat's Versa-Link System for Caterpillar Exacavators" Catapillar Inc., Jan. 1987 4 pages.

"Performance plus Excavator Buckets—Quick Couplers" Balderson Inc., Dec. 1989 4 pages.

Craig's Machine Shop Ltd, 2 pages, Feb. 1990.

*Primary Examiner*—Donald W. Underwood

*Attorney, Agent, or Firm*—Robert M. Phipps

[57] ABSTRACT

A quick coupling apparatus for detachably securing an implement such as a bucket, air or hydraulic hammer, tamper or any other attachment to a vehicle having a lifting and tilting mechanism such as an excavator. The apparatus includes a pair of hinge plates secured to the implement and two associated link assemblies adapted for mounting on the lifting and tilting mechanism of the vehicle and which engage and disengage the hinge plates to detachably secure the implement to the vehicle.

7 Claims, 6 Drawing Sheets

QUICK COUPLING ARRANGEMENT FOR EXCAVATOR BUCKETS AND THE LIKE

FIELD OF THE INVENTION

This invention relates to a coupling apparatus that is utilized to quick-couple and uncouple various attachments such as buckets, hydraulic hammers, drills, rippers, etc. to the support arm of a vehicle such as an excavator, loader-backhoe or the like.

BACKGROUND OF THE INVENTION

In recent years the hydraulic excavator and loader-backhoe have become increasingly popular as a means of moving material in and around construction sites and just as the excavator and loader-backhoe population has increased so has the variety of attachments for these machines. Thus, in order to utilize his equipment to the fullest, it is not uncommon for the owner of such equipment to have several attachments such as a trenching or digging bucket, a ditching or finishing bucket or a hydraulic rock hammer, drill or tamper.

Conventionally, the changing from one attachment to another requires the driving or pressing out of pins which were used to mount these attachments to the arm of these machines. Over a period of years there have been several types of quick-coupling devices designed and patented. Some of these couplings utilize a form of an adapter which pins to the arm of the excavator and contains either a female or male receptacle which engages a corresponding male or female receptacle on the attachment, an example of which is disclosed in Canadian Patent No. 1,081,171. The problem which arises from this type of coupler is that it moves the pivot point of the bucket further from the cutting edge of the bucket or tip radius, which greatly reduces the digging force of the bucket. Also because of the extra weight of the adapter and associated receptacles in comparison to a standard bucket, the lifting capacity of the excavator is affected in that the capacity of the bucket will be reduced in relationship to the extra weight of the adapter and therefore the performance is affected.

Other designs have been developed to overcome the adapter problem. One such type is Canadian Patent No. 1,109,427 which uses links between the pivot pin and power link pin. These links and protruding pins and sleeves are designed to engage hinge plates or mounting lugs which are attached to the bucket or attachment and to the rear with a spring loaded locking arrangement. The positioning of the receptacles in the hinge plates is very close to the original pin bores so as not to affect the digging geometry and forces. But by having the receptacle in the hinge plate which receives the pivot pin in the arm open towards the front or cutting edge of the bucket, when the arm is pulled in toward the machine, as in the digging cycle, all the force generated at the pivot pin is now transferred to the rear or power link pin which differs from an original bucket.

With the increasing use of hydraulic rock hammers on demolition and excavating sites because of the restrictive use of explosives, another problem with quick couplers has surfaced. The problem is that a hydraulic hammer mounted on the arm of an excavator produces very severe reciprocating movement on the mounting pins and coupling and this has a tendency to loosen the coupling arrangement on many quick couplers currently available for excavators and loader backhoes. As can be seen in Canadian Patents 1,109,427 and 1,259,958 there is no provision to positively lock the front pin in the coupling arrangement. This movement causes accelerated wear on the parts of the couplers which leads to premature failure of the coupling.

Furthermore, many couplers on the market today have either a spring loaded or hydraulic locking arrangement which is not visible from the cab of the machine by the operator. As a result, he is not certain that the coupling is fully locked unless he leaves the cab to check which defeats the purpose of the spring loaded or hydraulic lock. On some couplers if the lock were to fail the bucket or attachment would fall off which creates a safety hazard on construction sites.

The design of the coupling apparatus according to the invention provides an advance in the related art by providing a coupling system which has a minimum number of parts, a minimum increase in the operating weight of the bucket or attachment, can be installed with little or no change in the position of the pivot pins from the original positions, a means to prevent the reciprocal movement of the pivot pins and provide a safer operator installed locking mechanism which is installed and removed from the operator's side of the machine. The lock is so mounted that it has to be fully retracted before the coupler will separate.

SUMMARY OF THE INVENTION

The quick coupling arrangement according to the invention includes a pair of hinge plates which are secured, preferably by welding, on to an implement such as a bucket and the arrangement also includes a pair of associated link members adapted to be secured or mounted on the terminal ends of the operating arms of the vehicle and which engage and disengage the hinge plates on the implement. The hinge plates include front and rear receptacles which are engaged by rollers on the link assemblies, the latter being actuated by the excavator's arm mechanism, the links being locked in place on the hinge plates by a suitable, detachable locking means.

According to a broad aspect, the invention relates to a quick-coupling apparatus for detachably securing an implement to actuating arms of an associated vehicle; said apparatus including a pair of hinge plates adapted to be secured on said implement and a pair of associated link assemblies adapted to be secured to said actuating arms and for detachable connection to said hinge plates; said linked assemblies each including front and rear rollers and pin means extending between and spacing said assemblies one from the other in side-by-side relation; front and rear receptacles on said hinge plates for the reception of the rollers on said link assemblies; said rear receptacles being contoured so that, when the front rollers on the link assemblies are directed into the front receptacles on the said hinge plates, by the said vehicles actuating arm and the rear rollers on the link assemblies are directed therein into the rear receptacles on the hinge plates by the vehicles power link, the front rollers on the link assemblies are moved into full engagement of the front receptacles on said hinge plates, and a means for releasably locking said link assemblies into said hinge plates.

BRIEF DESCRIPTION OF THE DRAWINGS

The invention is illustrated by way of example in the accompanying drawings in which.

DETAILED DESCRIPTION OF THE PREFERRED EMBODIMENT

Figure 14:
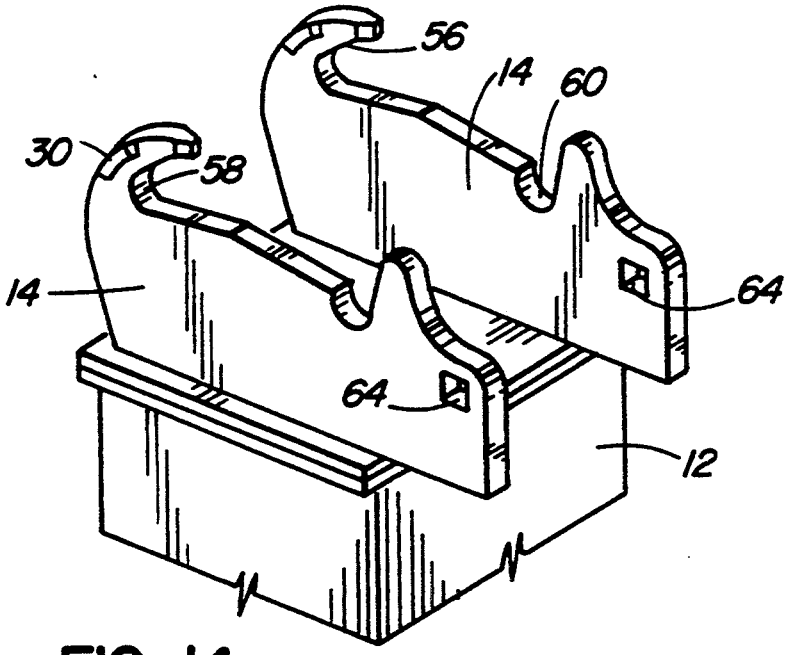
FIG. 14 is a perspective view of the hinge plates on an attachment.
Figure 15:
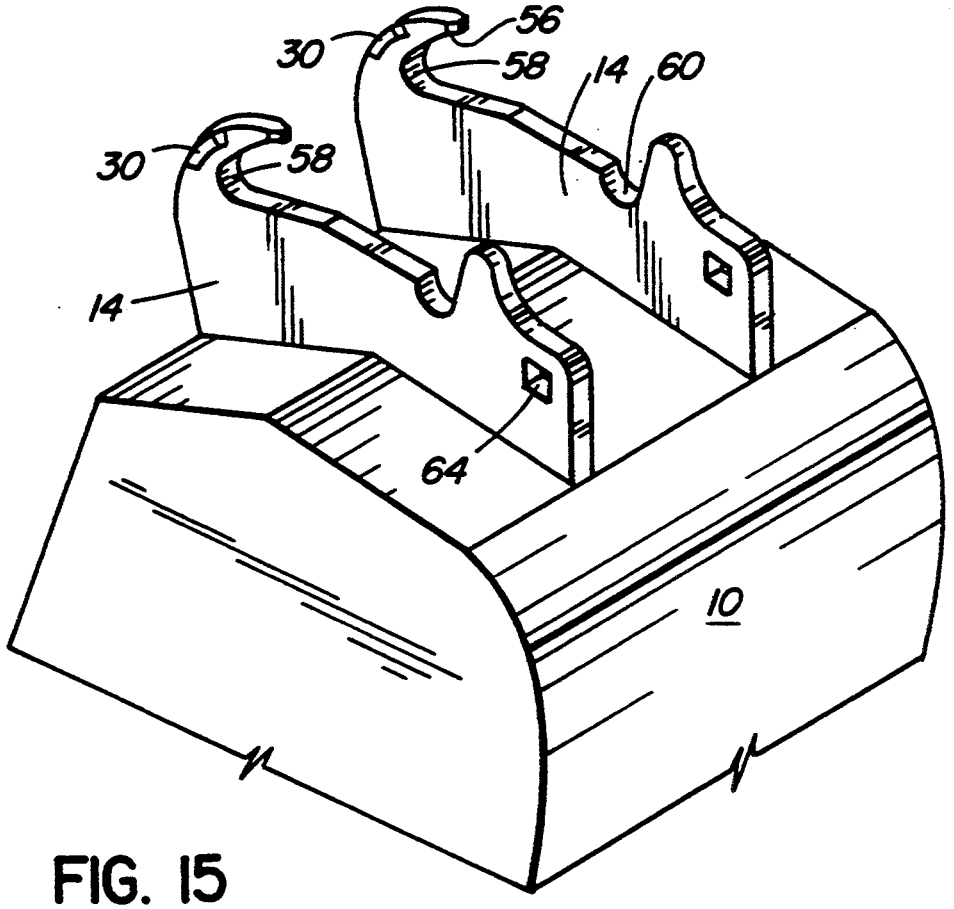
FIG. 15 is a perspective view of the hinge plates on a bucket.

Referring to the drawings, and initially to FIGS. 14 and 15, the coupling apparatus consists of (a) two hinge plates 14 which are spaced in parallel to one another and secured, preferably by welding, to an implement such as a bucket 10 or other attachment 12, and (b) two link assemblies 20 and 22, shown in FIGS. 1–4, together with their necessary sub-parts, as will be described.

Figure 12:
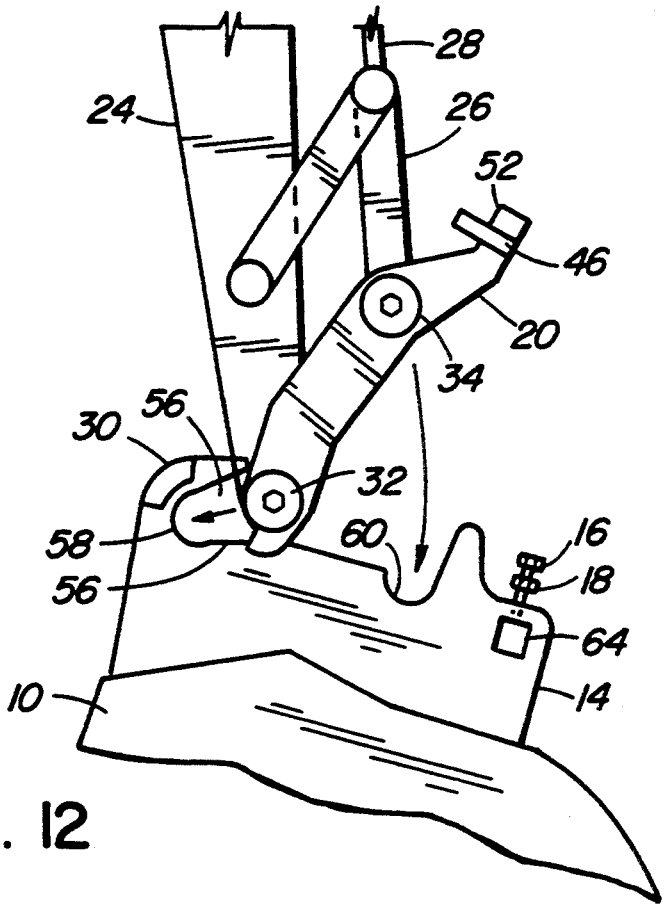
FIG. 12 is a side view of the arm and power link of an excavator with the link assemblies attached thereto and showing the link assemblies initially engaging the hinge plates.
Figure 13:
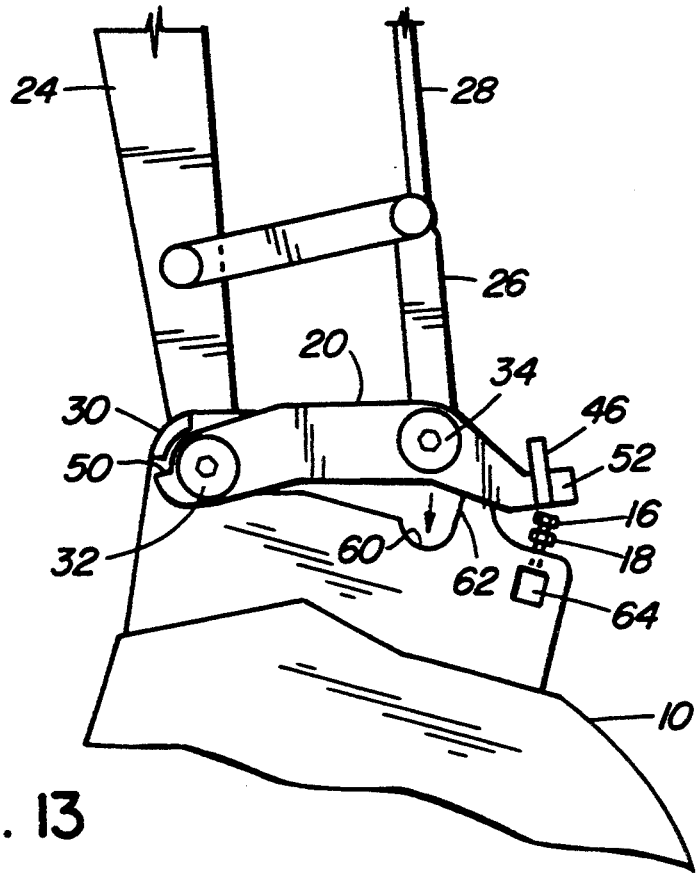
FIG. 13 is a further side view of the arm and power link showing how the power link rotates the link assemblies into contact with the rear receptacle on the hinge plates.

As shown in FIGS. 12 and 13, the two link assemblies 20, 22 are detachably secured to the operating mechanism, in this case an arm 24 and power linkage 26, of a vehicle such as an excavator, not shown. The link assemblies are attached to the arm and power linkage by a first or front pin assembly 32 which connects to the arm 24 and a second or rear pin assembly 34 which connects to the power link 26, as shown in FIGS. 12 and 13 and in the plan view of FIG. 9.

Figure 7:
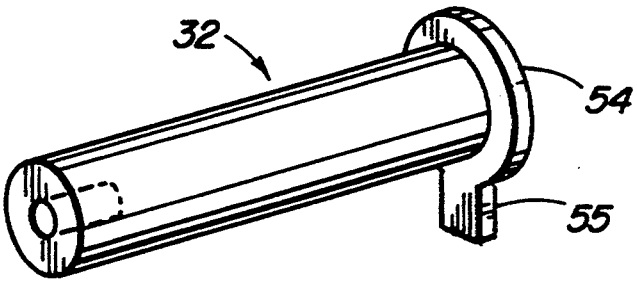
FIG. 7 is a perspective view of one of the pin assemblies.
Figure 9:
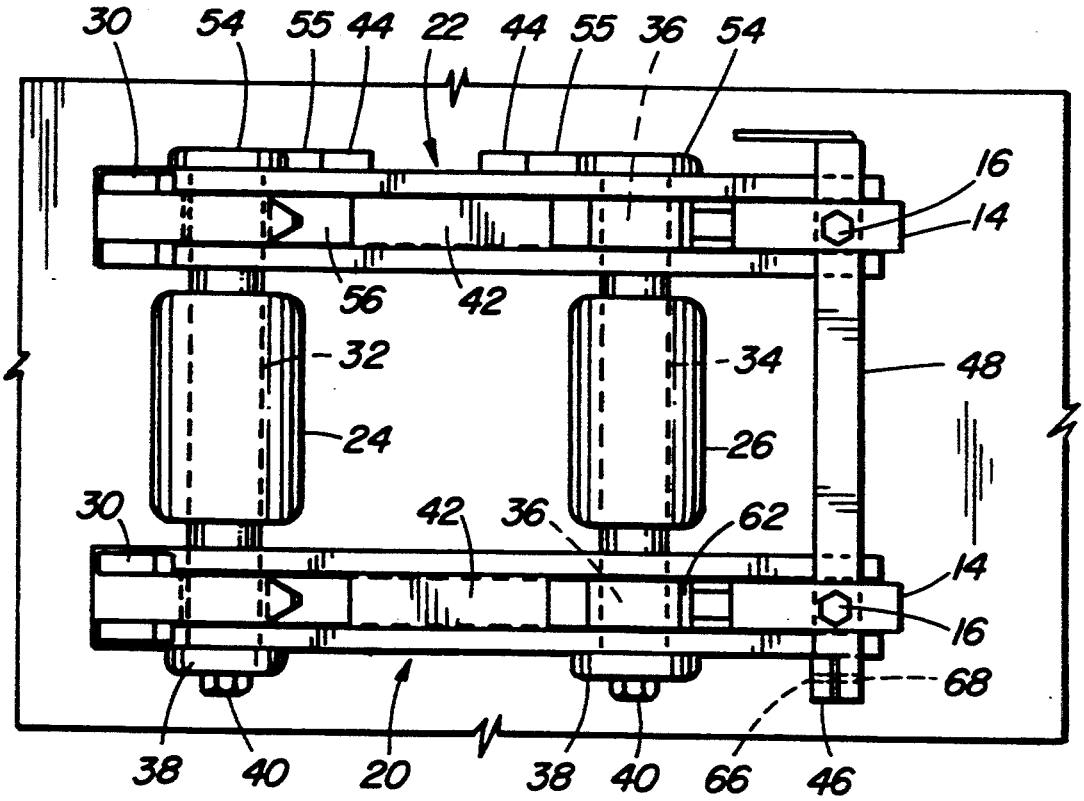
FIG. 9 is a top view of an assembled coupler, including the link assemblies and hinge plates mounted on a bucket or attachment.
Figure 10:
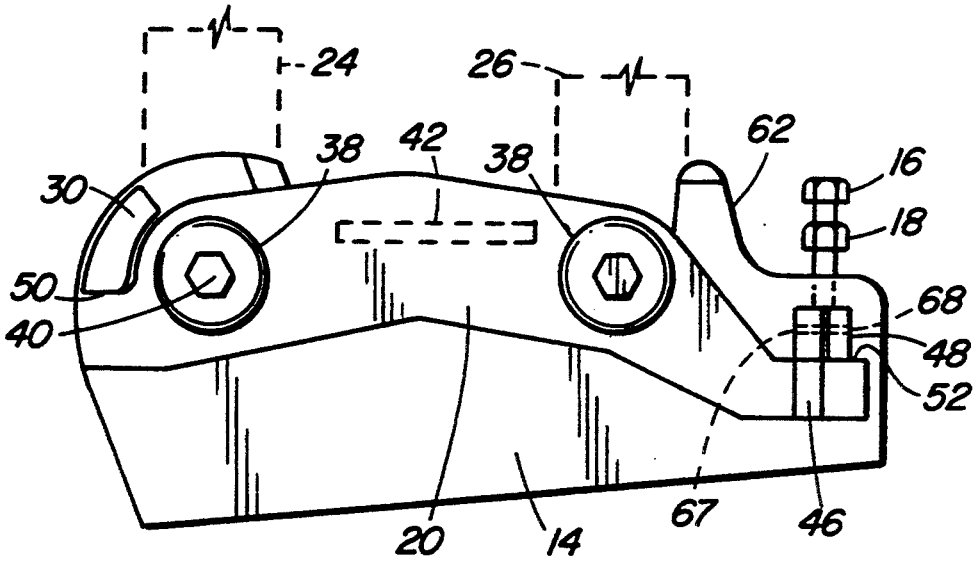
FIG. 10 is a side elevation view of the assembled coupler of FIG. 9 as seen from the right side thereof.

The link assemblies 20, 22 are retained on the pin assemblies 32 and 34 by a welded end cap 54, FIGS. 7 and 9, and by a cap 38 which is secured by a bolt 40 threaded into the ends of the pin assemblies 32 and 34 also as illustrated in FIGS. 9 and 10.

Figure 11:
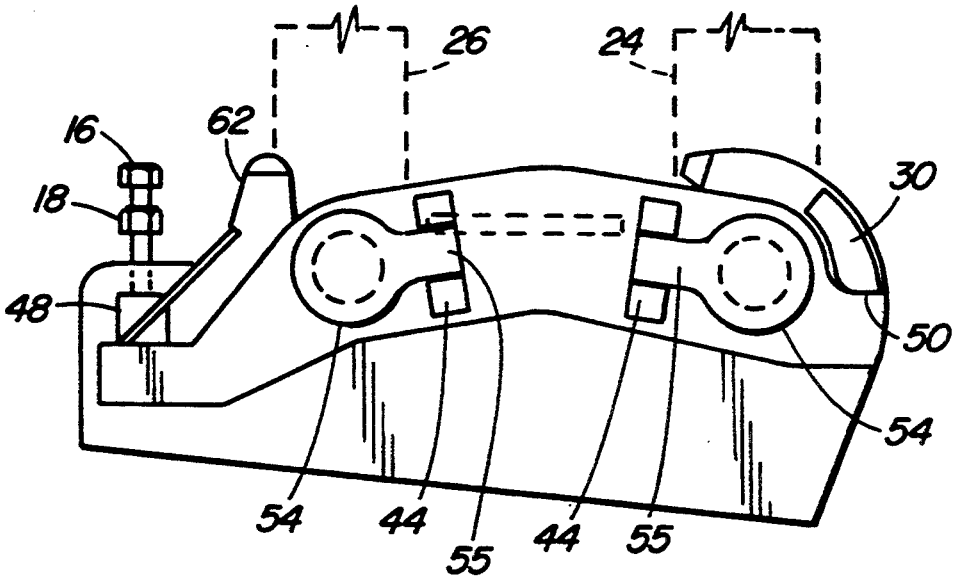
FIG. 11 is a side elevation view of the assembled coupler of FIG. 9 as seen from the left side thereof.

The pin assemblies 32 and 34 are constructed so as to rotate freely in the arm 24 and power link 26 of the vehicle. However, in the link assembly 22 as shown in FIGS. 9 and 11, the end cap 54 has an arm 55 which locates between blocks 44 that are mounted on the link assembly side plate, FIG. 11.

Rollers 36 are mounted intermediate the side plates of the link assemblies 20, 22 and are free to rotate within the link assemblies 20, 22 and on the pin assemblies 32, 34 because web 42 keeps the side plates of the link assembly apart.

As shown in FIGS. 5, 6, 12 and 13, the hinge plates 14 have front contoured receptacles 58 and rear contoured receptacles 60 to receive the rollers 36 mounted on the link assemblies 20 and 22. The front receptacles 58 also have ramps or inclinations 56 the function of which is to assist the engagement of the rollers 36 into the front receptacles 58 in the event that there is a misalignment between the implement bucket 10 or attachment 12 and the excavator. The rear contoured receptacles 60 also have ramps or inclinations 62 which serve to force the rollers 36 on the pin assemblies 32 into full engagement with the front receptacles 58. After full engagement of the rollers 36 on the pin assemblies 32 into the front receptacles 58, the rear receptacles 60 will then accept the rollers 36 which are mounted on the pin assemblies 34 that are connected to the power link 26.

Figure 1:
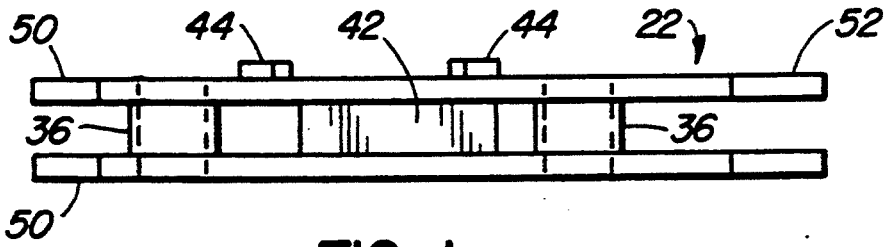
FIG. 1 is a plan view of a left link assembly, showing the various parts and surfaces.
Figure 2:
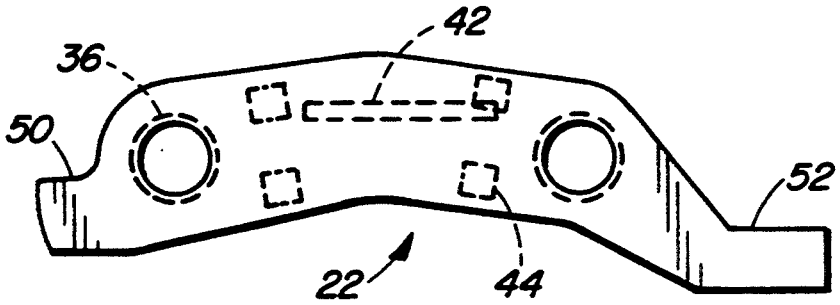
FIG. 2 is a side elevation view of the assembly of FIG. 1.
Figure 3:
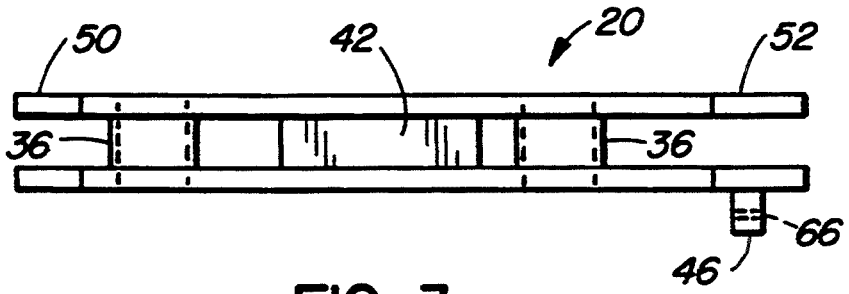
FIG. 3 is a plan view of a right link assembly showing the various parts and surfaces thereof.
Figure 4:
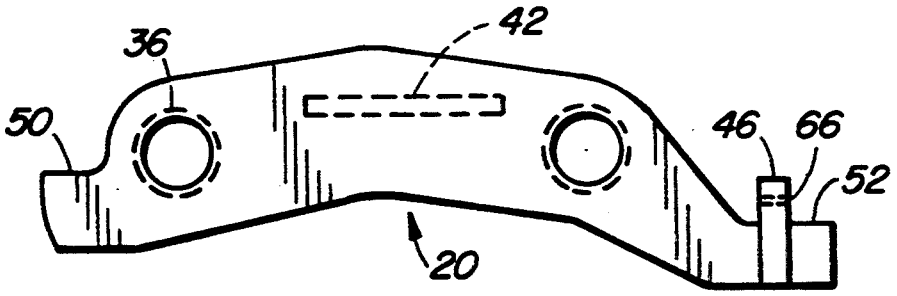
FIG. 4 is a side elevation view of the assembly of FIG. 3.
Figure 5:
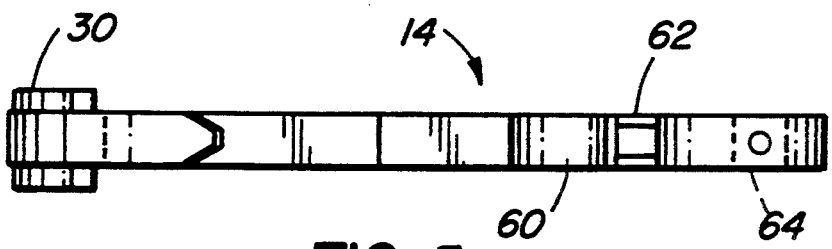
FIGS. 5 and 6 are plan and elevation views respectively of a hinge plate showing the various parts and surfaces thereof.
Figure 6:
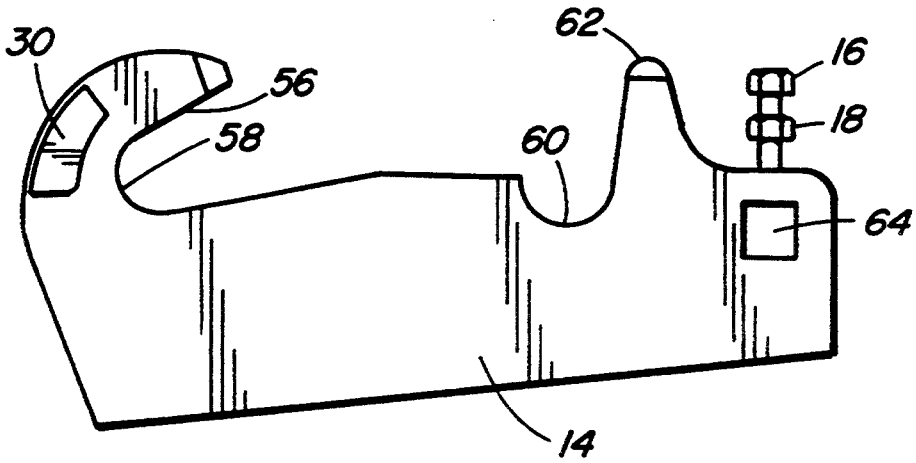
Figure 8:
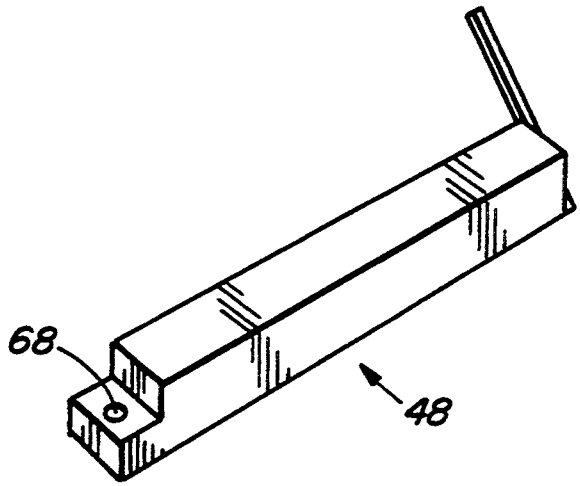
FIG. 8 is a perspective view of a lock bar assembly.

As shown in FIG. 6, an aperture 64 is provided in each of the hinge plates 14 and which will receive a locking bar 48 (FIG. 8), allowing the locking bar to pass therethrough. A forcing screw 16 is also included in each hinge plate 14 together with a lock nut 18 which serves to tighten and secure the locking bar 48 in position after the coupling is made.

A description of the operation of the coupling apparatus now follows.

When the operator of a vehicle such as an excavator wishes to attach an implement such as a bucket 10 or attachment 12 on the excavator, the operator will position the arm 24 and power link 26 over the bucket 10 which is in a normal upright position on the ground or other supporting surface. As shown in FIG. 12, the operator will then bring the arm 24 downwardly and towards the front receptacles 58 of the hinge plates 14 and, as this happens, the rollers 36 mounted within the link assemblies 20, 22 and on the pin assembly 32, make contact with the ramps 56 and are guided into the front receptacles 58.

As shown in FIG. 13, the operator then activates the bucket cylinder 28 which causes the cylinder to extend and rotate the link assemblies 20, 22 so that the rollers 36 mounted in the link assemblies 20, 22 and on the pin assembly 34, come to rest in the rear receptacle 60 on the hinge plate 14 as shown in FIG. 13.

After the engagement of the rollers 36 into the rear receptacle 60, the apparatus assumes the position in FIGS. 9, 10 and 11. The operator then passes the locking bar 48, best seen in FIG. 8 and 9, through the apertures 64 in the hinge plates 14 until the bar makes contact with the stop 46. A retaining pin 67 is then installed through the aperture 66 in the stop 46 mounted on link assembly side plate and aperture 68 in the locking bar 48. The two forcing screws 16 in the hinge plates 14 are now turned down to contact locking bar 48 to secure it in position. The locking bar 48 thus contacts the upper end surfaces of arms 52 on the link assemblies 20, 22 as shown in FIGS. 10 and 11 and this causes the assemblies 20 and 22 to rotate further and cause upper surfaces on arms 50 (FIGS. 10 and 13) on link assemblies 20 and 22 to contact the stop blocks 30 on the hinge plates 14. The lock nuts 18 on the force screws 16 are then turned down and tightened to prevent the forcing screws 16 from becoming loose.

When the locking bar 48 is forced down onto arm 52 by the screws 16 it will cause a pre-load to take effect on the link assemblies 20, 22 because the upper surfaces on arms 50 contact the stop blocks 30 before the rollers 36 on the pin assemblies 34 are fully seated in the rear receptacles 60. The system is then able to absorb the reciprocating forces that are generated, for example, by an hydraulic hammer.

With the type of locking arrangement provided by this invention, digging forces of an excavator utilizing the invention are transmitted to four points:

(a) the rollers 36 into the front receptacles 58;

(b) the rollers 36 into the rear receptacles 60;

(c) the contact surfaces of arms 50 on to the stop blocks 30; and (d) the locking bar 48 on to the surfaces of arms 52 of the link assemblies 20 and 22.

The assembly can be quickly detached from a bucket 10 or attachment 12 by running off the lock nuts 18, screwing out the force screws 16 and removing the locking bar 48. The excavator arms 24 and 26 can then be activated to reverse the movement of the links 20 and 22 as shown in FIGS. 12 and 13 thereby detaching the excavator from the bucket or attachment.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A quick-coupling apparatus for detachably securing an implement to actuating arms of an associated vehicle; said apparatus including a pair of hinge plates adapted to be secured on said implement and a pair of associated link assemblies adapted to be secured to said actuating arms and for detachable connection to said hinge plates;

said link assemblies each including front and rear rollers and pin assembly means extending between and through said link assemblies and arranging said link assemblies in parallel, side-by-side relation;

front and rear receptacles on said hinge plates for the reception of the rollers on said link assemblies, said front receptacles opening toward the rear receptacles;

stop blocks on said hinge plates located adjacent said front receptacles;

arms on said link assemblies extending outwardly from the ends thereof; and means for releasably locking said link assemblies into said hinge plates;

said rear receptacles being so contoured that, when the rear rollers on the link assemblies are directed therein by said vehicle actuating arms, the front rollers on said link assemblies are moved to engage the front receptacles on said hinge plates, the arms extending from one end of the link assemblies engaging said stop blocks and the arms on the other ends of the link assemblies being engaged by said locking means.

2. Apparatus according to claim 1 including transversely aligned apertures in said hinge plates adjacent the ends thereof incorporating said rear receptacles; and wherein said releasable locking means comprises a locking bar for extension through said hinge plate apertures subsequent to engagement of said link assemblies with said hinge plates and adapted to engage said link assembly arms adjacent said rear receptacles for securing said link assemblies in the hinge plates; and means for securing said locking bar in engagement with said link assemblies.

3. Apparatus according to claim 2 wherein said locking bar securing means comprises forcing screws located in said hinge plates to apply securing pressure on said locking bar and said link assembly arms thereby applying a seating force to said rollers on said link assemblies in the contoured rear receptacles and thereby pre-loading pressure of the link assembly arms against said stop blocks.

4. A quick-coupling apparatus for detachably securing an implement to actuating arms of an associated vehicle; said apparatus including a pair of hinge plates adapted to be secured on said implement and a pair of associated link assemblies adapted to be secured to said actuating arms and for detachable connection to said hinge plates;

said link assemblies each including front and rear rollers and pin assembly means extending between and through said link assemblies and arranging said link assemblies in parallel side-by-side relation;

front and rear receptacles on said hinge plates for the reception of the rollers on said link assemblies, said front receptacles opening in a direction toward said rear receptacles;

stop blocks on said hinge plates located adjacent said front receptacles;

means for releasably locking said link assemblies into said hinge plates;

said link assemblies including arms extending outwardly from the ends thereof; the arms on one end of said link assemblies being engaged by said stop blocks adjacent the front receptacles and the arms on the other ends of the link assemblies being engaged by said releasable locking means;

said rear receptacles being so contoured that, when the rear rollers on the link assemblies are directed therein by said vehicle actuating arms, the front rollers on said link assemblies are moved to engage the front receptacles on said hinge plates; and means effecting a pre-load on said link assemblies on the hinge plates subsequent to seating said rollers in said receptacles.

5. Apparatus according to claim 4 wherein said pre-load effecting means comprises forcing screws located in said hinge plates to apply pressure on said releasable locking means and said link assembly arms thereby applying a seating force to said link assembly rollers in the front and rear receptacles and thereby pre-loading pressure of the arms against the stop blocks.

6. A quick-coupling apparatus for detachably securing an implement to actuating arms of an associated vehicle; said apparatus including a pair of hinge plates adapted to be secured on said implement and a pair of associated link assemblies adapted to be secured to said actuating arms and for detachable connection to said hinge plates;

said link assemblies each including front and rear rollers and pin assembly means extending between and through said link assemblies and arranging said link assemblies in parallel side-by-side relation;

front and rear receptacles on said hinge plates for the reception of the rollers on said link assemblies, said front receptacles facing rearwardly toward said rear receptacles;

said rear receptacles being so contoured that, when the rear rollers on the link assemblies are directed therein by said vehicle actuating arms, the front rollers on said link assemblies are moved to engage the front receptacles on said hinge plates;

stop blocks on said hinge plates located adjacent said front receptacles;

said link assemblies including arms extending forwardly and rearwardly of said front and rear rollers respectively, the forward arms engaging said stop blocks;

means for releasably locking said link assemblies into said hinge plates comprising aligned apertures in said hinge plates adjacent the ends thereof which incorporates said rear receptacles; a locking bar adapted to extend through said apertures and engage said rearwardly extending arms following engagement of said link assemblies with said hinge plates; and means on said hinge plates to apply seating pressure on said rearward arms of said link assemblies into said rear receptacles and thereby effect a preload of the assemblies into said front and rear receptacles, and means for locking said assemblies in the preloaded position.

7. Apparatus according to claim 6 wherein said pressure applying means on said hinge plates comprises forcing screws located in said hinge plates to apply pressure on said locking bar and said link assembly arms thereby applying a seating force to said rear rollers on said link assemblies in the contoured rear receptacles to thereby pre-load pressure of the forwardly extending link assembly arms against the stop blocks.

* * * * *